US011142225B2

(12) United States Patent
Saxton

(10) Patent No.: US 11,142,225 B2
(45) Date of Patent: Oct. 12, 2021

(54) COVERED HOPPER CAR

(71) Applicant: Gunderson LLC, Portland, OR (US)

(72) Inventor: Gregory J. Saxton, Portland, OR (US)

(73) Assignee: Gunderson LLC, Portland, OR (US)

( * ) Notice: Subject to any disclaimer, the term of this patent is extended or adjusted under 35 U.S.C. 154(b) by 377 days.

(21) Appl. No.: 16/259,041

(22) Filed: Jan. 28, 2019

(65) Prior Publication Data

US 2020/0239039 A1 Jul. 30, 2020

(51) Int. Cl.

| | |
|---|---|
| ***B61D 17/08*** | (2006.01) |
| ***B61D 17/04*** | (2006.01) |
| ***B61D 7/02*** | (2006.01) |
| *B61D 17/12* | (2006.01) |

(52) U.S. Cl.

CPC ..... *B61D 17/08* (2013.01); *B61D 7/02* (2013.01); *B61D 17/048* (2013.01); *B61D 17/12* (2013.01)

(58) Field of Classification Search

CPC ..... B61D 17/18; B61D 7/02; B61D 17/048; B61D 17/12; B61D 17/08; B61D 17/16; B61D 17/06; B61D 7/00; B61D 49/00; B61D 17/04; B61D 17/041; B61D 3/16

See application file for complete search history.

(56) References Cited

U.S. PATENT DOCUMENTS

| | | | | |
|---|---|---|---|---|
| 2,079,862 A | | 5/1937 | Kiesel, Jr. | |
| 2,092,457 A | | 9/1937 | Kiesel, Jr. | |
| 3,040,679 A | | 6/1962 | Warntz | |
| 3,066,621 A | * | 12/1962 | Dean | B61D 17/043 105/401 |
| 3,339,499 A | * | 9/1967 | Franklin | B61D 7/00 105/248 |
| 3,399,499 A | | 9/1968 | Stetz et al. | |
| 3,490,387 A | | 1/1970 | Halcomb | |
| 3,495,548 A | | 2/1970 | Rollins | |
| 3,509,827 A | | 5/1970 | Sutter | |
| 3,515,051 A | | 6/1970 | Pulcrano | |
| 3,538,857 A | | 11/1970 | Mowatt-Larsen | |
| 3,557,713 A | | 1/1971 | Spence et al. | |
| 3,570,592 A | | 3/1971 | Rollins | |
| 3,577,932 A | | 5/1971 | Pulcrano et al. | |
| 3,583,330 A | | 6/1971 | Freudman | |
| 3,583,331 A | | 6/1971 | Mowatt-Larssen | |
| 3,583,564 A | | 6/1971 | Rollins | |
| 3,675,591 A | | 7/1972 | Nagy et al. | |
| 3,789,773 A | | 2/1974 | McNalley et al. | |
| 3,918,370 A | | 11/1975 | Campbell et al. | |
| 3,921,537 A | | 11/1975 | Fleshman et al. | |
| 4,003,319 A | | 1/1977 | Campbell et al. | |

(Continued)

FOREIGN PATENT DOCUMENTS

| | | | | |
|---|---|---|---|---|
| CN | 104228859 A | * | 12/2014 | B61D 17/08 |
| GB | 204490 | | 10/1923 | |

*Primary Examiner* — Zachary L Kuhfuss
*Assistant Examiner* — Cheng Lin
(74) *Attorney, Agent, or Firm* — Chernoff Vilhauer LLP

(57) ABSTRACT

A covered hopper railroad freight car having a car body whose opposite longitudinal sides include generally flat, parallel, substantially vertical upper side wall portions free from outwardly protruding structural strength members. A top chord of each of the side walls of the car is defined by a pair of parallel bend lines extending longitudinally along the upper margin of each side wall, and a roof is welded to the top chords of the side walls.

10 Claims, 4 Drawing Sheets

(56) References Cited

U.S. PATENT DOCUMENTS

| | | | | | |
|---|---|---|---|---|---|
| 4,168,665 | A | | 9/1979 | Needham et al. | |
| 4,232,989 | A | | 11/1980 | Miller | |
| 4,262,602 | A | | 4/1981 | Patil et al. | |
| 4,292,898 | A | | 10/1981 | Gordon et al. | |
| 4,334,481 | A | | 6/1982 | Przbylinski et al. | |
| 4,352,331 | A | | 10/1982 | Anderson et al. | |
| 4,362,111 | A | | 12/1982 | Stark et al. | |
| 4,366,757 | A | | 1/1983 | Funk | |
| 4,377,058 | A | | 3/1983 | Hallam et al. | |
| 4,484,528 | A | | 11/1984 | Anderson et al. | |
| 4,493,266 | A | | 1/1985 | Augustine, Jr. | |
| 4,497,258 | A | | 2/1985 | Ruhmann et al. | |
| 4,498,400 | A | | 2/1985 | Vorwerk et al. | |
| 4,598,646 | A | * | 7/1986 | Dugge | B61D 7/02 105/248 |
| 4,608,931 | A | | 9/1986 | Ruhmann et al. | |
| 4,630,548 | A | | 12/1986 | Wiger et al. | |
| 4,696,088 | A | | 9/1987 | Miller | |
| 4,741,274 | A | | 5/1988 | Ferris et al. | |
| 4,875,417 | A | * | 10/1989 | Coulborn | B61D 7/00 105/248 |
| 4,884,511 | A | | 12/1989 | Hallam et al. | |
| 4,893,568 | A | | 1/1990 | Adams | |
| 4,898,101 | A | | 2/1990 | Harter | |
| 4,922,833 | A | | 5/1990 | Coulborn et al. | |
| 4,930,427 | A | | 6/1990 | Ritter et al. | |
| 4,941,411 | A | | 7/1990 | Wong | |
| 4,966,081 | A | | 10/1990 | Dominguez et al. | |
| 5,144,895 | A | | 9/1992 | Murray | |
| 5,159,882 | A | | 11/1992 | Krug et al. | |
| 5,209,166 | A | | 5/1993 | Tylisz et al. | |
| 5,259,322 | A | | 11/1993 | Dominguez et al. | |
| 5,263,421 | A | | 11/1993 | Lichty et al. | |
| 5,367,958 | A | | 11/1994 | Weiss et al. | |
| 5,390,607 | A | | 2/1995 | Lydic | |
| 5,762,003 | A | | 6/1998 | Downes et al. | |
| 5,860,366 | A | | 1/1999 | Lydic | |
| 5,934,200 | A | | 8/1999 | Lydic | |
| 6,019,049 | A | | 2/2000 | Gaydos et al. | |
| 6,044,771 | A | | 4/2000 | Nguyen | |
| 6,067,912 | A | | 5/2000 | Miller | |
| 6,119,345 | A | | 9/2000 | Lydic et al. | |
| 6,302,031 | B1 | | 1/2001 | Smith et al. | |
| 6,220,502 | B1 | | 4/2001 | Gallinger et al. | |
| 6,237,505 | B1 | | 5/2001 | Sande et al. | |
| 6,244,191 | B1 | | 6/2001 | Lydic | |
| 6,276,058 | B1 | | 8/2001 | Gallinger et al. | |
| 6,279,217 | B1 | | 8/2001 | Gallinger et al. | |
| 6,279,487 | B1 | | 8/2001 | Gaydos et al. | |
| 6,502,518 | B1 | | 1/2003 | Miller | |
| 6,604,469 | B1 | | 8/2003 | Galvan et al. | |
| 7,536,957 | B2 | * | 5/2009 | Bush | B61D 7/00 105/247 |
| 8,622,004 | B2 | | 1/2014 | Forbes et al. | |
| 10,124,817 | B2 | * | 11/2018 | Yoshida | B61D 17/08 |
| 2002/0157563 | A1 | | 10/2002 | Richmond et al. | |
| 2004/0244638 | A1 | | 12/2004 | Taylor | |
| 2005/0056185 | A1 | | 3/2005 | Herzog et al. | |
| 2005/0056186 | A1 | | 3/2005 | Creighton et al. | |
| 2008/0035014 | A1 | | 2/2008 | Gillis et al. | |
| 2008/0127854 | A1 | | 6/2008 | Forbes et al. | |
| 2009/0241799 | A1 | | 10/2009 | Saxton et al. | |
| 2018/0127004 | A1 | | 11/2018 | Gillis | |
| 2018/0334178 | A1 | | 11/2018 | Gillis | |

* cited by examiner

COVERED HOPPER CAR

BACKGROUND OF THE INVENTION

The present application relates to railroad freight cars and, in particular, to a covered hopper car.

Railroad freight cars are frequently designed for use in specific markets. Hopper cars are often designed with a volumetric capacity allowing a car fully loaded with an intended type of cargo to have a gross weight that approaches the maximum weight permitted to be carried on the rails where the car is intended to be operated. Overall efficiency of carriage of goods may be improved by car designs which reduce the length of a car loaded to its maximum allowable weight. Shorter cars may permit more cars to be included in a train of a maximum length limited by factors such as the lengths of sidings. Additionally, a shorter car may have a lower tare weight yet have a desired volumetric capacity and adequate strength.

Covered railroad hopper car bodies have conventionally been constructed with flat sides reinforced by external side posts that extend laterally beyond the side sheets of the hoppers. An entire car, including such external side posts, is required not to extend into the space beyond the clearance limits for the railways on which such hopper cars are to be operated, and so the available cargo volume of cars of that construction is limited by the space occupied by the external side posts.

Some hopper cars with large amounts of welded sheet steel construction have had problems with their appearance, as shrinkage of welds has caused visible waviness in visible surface areas.

In order to provide for increased volumetric capacity some covered hopper cars have been constructed with longitudinal side plates that are convex, curved about a longitudinal horizontal axis of curvature. The curvature of such side plates provides some stiffening of the car body without incorporating the weight of external side posts. Some such cars include external longitudinal structural members, such as a side sill and a top chord, that contribute to sufficient strength. While such a design provides additional volumetric capacity for such cars by comparison with cars equipped with external side posts, the curvature results in reduced width of the hopper itself at the top of the car body and such cars thus have less than the maximum volumetric cargo capacity that could fit within the prescribed clearance diagram that limits the external dimensions of the car.

What is desired, then, is an improved covered hopper car with adequate strength, greater volumetric cargo capacity than hopper cars with the previously mentioned curved side walls, with external dimensions within the size limitations in effect where such a car is to be operated, and whose appearance is unaffected by weld shrinkage during construction of the car.

SUMMARY OF THE INVENTION

A covered hopper car as disclosed herein provides answers to some of the previously-mentioned shortcomings of previously known hopper cars.

In one embodiment, the covered hopper freight car disclosed herein includes sides having upper side wall sheet portions that are mainly flat and substantially vertical.

In one embodiment of the hopper car disclosed herein, each side wall may include a stiffening top chord portion, defined by a pair of parallel bends extending longitudinally along the upper portion of the substantially vertical upper side wall sheet portions of the hopper car.

In one embodiment of the covered hopper freight car disclosed herein longitudinally-extending corrugations may be provided to function as stiffeners at an intermediate height within the generally flat upper portions of the sides of the hopper car, while lower portions of the sides of the hopper car may incorporate a curved configuration similar to that of previously known curved-sided hopper cars.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
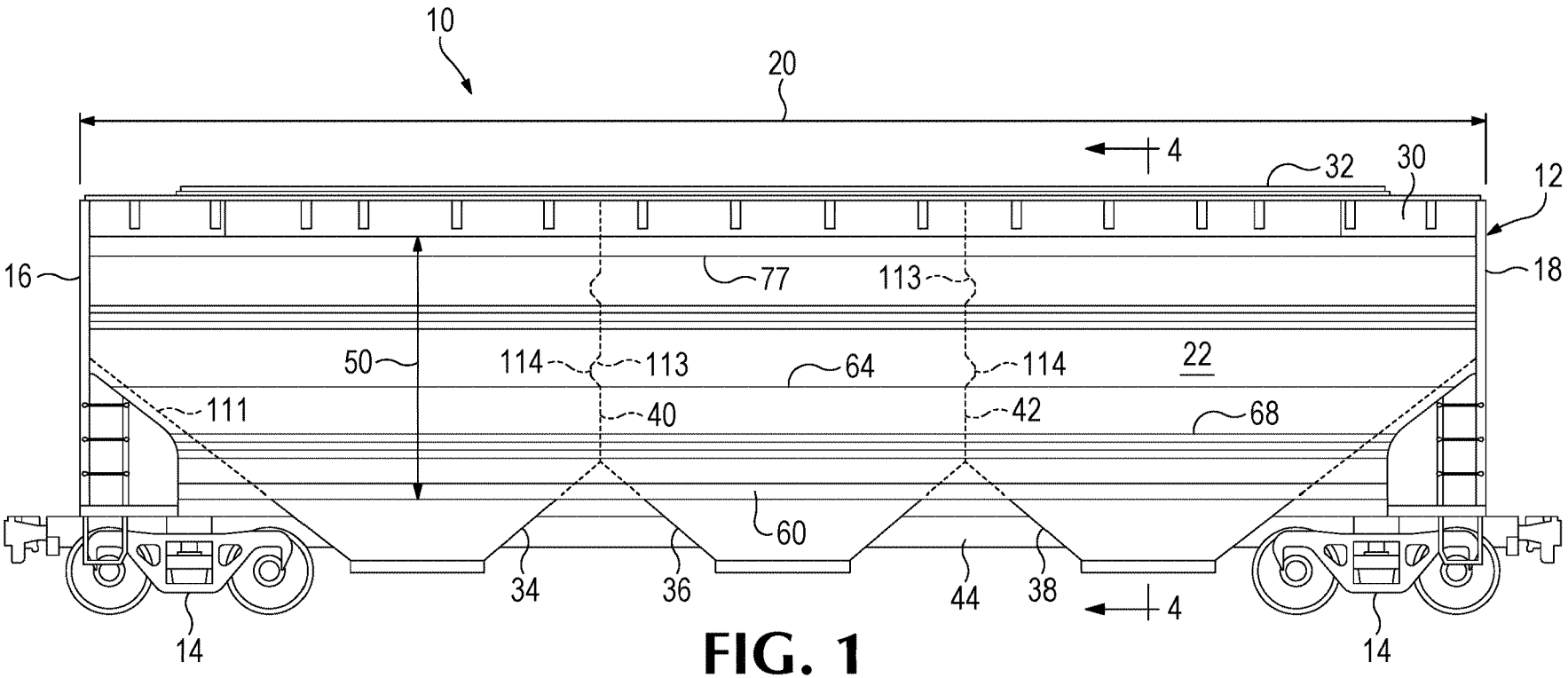
FIG. 1 is a side elevational view of a covered hopper type railroad freight car including side walls having upper side wall sheets and integral top chords.
Figure 2:
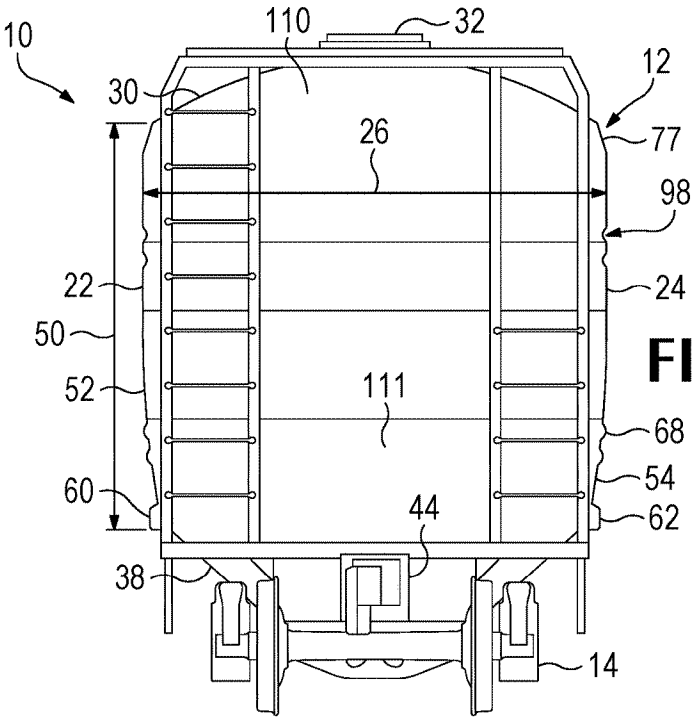
FIG. 2 is an end elevational view of the covered hopper railroad freight car shown in FIG. 1.
Figure 3:
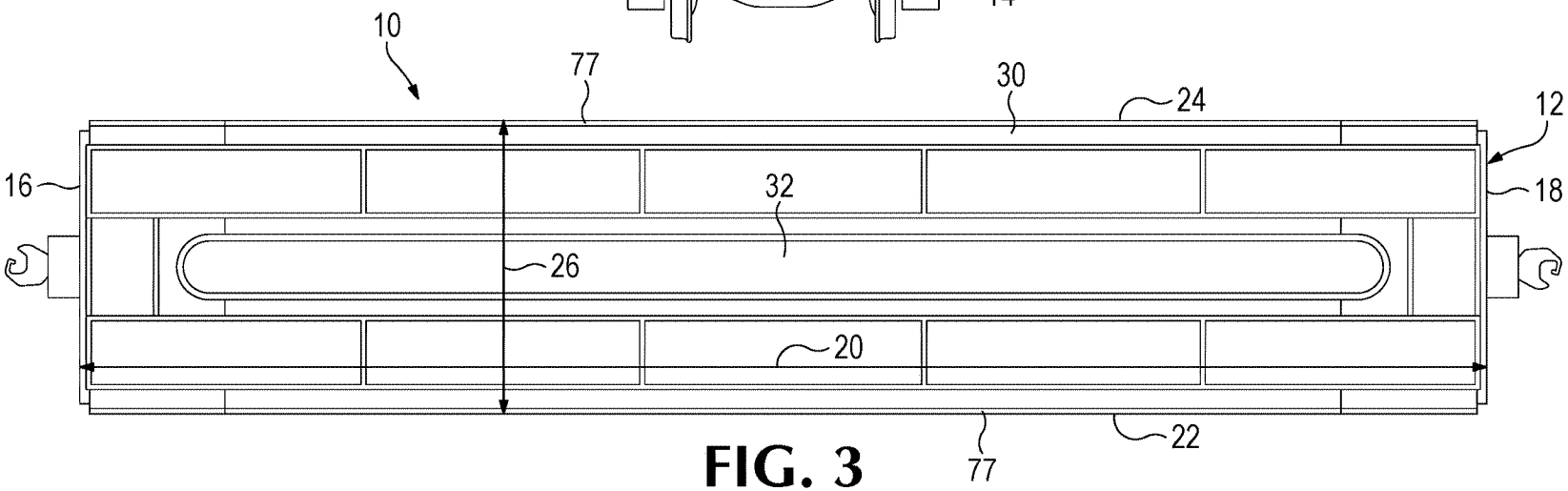
FIG. 3 is a top plan view of the covered hopper railroad freight car shown in FIGS. 1 and 2.

Referring now to the drawings that form a portion of the disclosure herein, FIGS. 1-3 show a railroad freight car 10 of the covered hopper type incorporating a novel side wall top chord structure.

The covered hopper car 10 includes a car body 12 carried on a pair of wheeled trucks 14 and having a pair of opposite ends 16 and 18 defining a length 20. A pair of opposite sides 22 and 24 define a width 26 of the car. A roof 30 is attached to and supported by the ends 16 and 18 and the sides 22 and 24 and may include a centrally-located, longitudinally-extending hatch 32 providing access to, for example, three separate cargo hoppers 34, 36, and 38 defined within the car body 12.

A pair of transversely-extending bulkheads 40 and 42 extend between the sides 22 and 24, separating the cargo hoppers 34, 36, and 38 from each other.

A center sill 44 may extend through the entire length of the car body, and an appropriate protective structure 46 may extend along the top of the center sill 44 within each hopper to assure that cargo is free to slide out of each hopper, rather than being able to remain atop the center sill 44 when the hopper is emptied.

Each of the opposite sides 22 and 24 of the car body 12 has a height 50 in the range of 105 inches to 125 inches, such as, for example, 114 3/16 inches. Each of the opposite sides 22 and 24 has a respective lower side wall sheet portion 52, 54 that is convexly curved, with a long radius of curvature about an axis of curvature (not shown) extending parallel with the length 20 of the car body 12. A tubular reinforcing member or bottom chord 60, 62 may extend horizontally along an outer side of each of the lower side portions 52, 54 on each side of the car body 12. The bottom chord 60 or 62 of each of the lower side portions 52, 54 may be joined, as by welding along a seam 57, to an upper margin 59 of a respective side slope sheet 58 of each of the hoppers 34, 36, and 38 of the car body 12.

The upper margins 64 of the lower portions 52, 54 of the sides 22 and 24 are spaced further apart laterally with respect to the car body 12 than are the lower margins 56. Longitudinally-extending horizontal reinforcing corrugations 68 may be provided in the lower portions 52, 54 of the sides 22, 24, roughly centered between each upper margin 64 and the bottom chord 60 or 62. The reinforcing corrugations 68 may be formed integrally in the sheet metal of the lower portions 52, 54 as a part of the process of forming the lower portions of the sides 22 and 24. Each corrugation 68 may have a width 67 in the range of 1 inch to 3 inches, or 2 inches, for example, and may protrude outwardly a distance 66 in the range of 3/8 inch to 3/4 inch, or 9/16 inch, for example, with respect to the lower portions of the sides 22, 24. The corrugations 68 may be separated by a distance 65 in the range of 1½ inches to 4 inches, or about 3 inches, for example. The lower portions 52 and 54 of the side walls may have a height 69 of 54 inches and may be of sheet steel having a thickness 70 in the range of 0.15 inch to 0.22 inch and that may be about 0.18 inch, for example.

Overlapping slightly and joined to the lower portions 52, 54 of the sides 22 and 24, as by appropriate weld joints 72 along the upper margins 64, are respective generally planar upper side wall sheet portions 73 and 74 of the sides 22 and 24. The upper side wall sheet portions 73 and 74 extend substantially vertically upward and parallel with each other, over a height 75 within a range of 38 inches to 62 inches and which may be about 50 inches, for example. The upper side wall portions 73 and 74 may also be of sheet steel having a thickness 76 in the range of 0.15 inch to 0.22 inch and which may be about 0.18 inch, for example. The upper side wall sheet portions 73 and 74 of the car body 12 may be spaced apart from each other by an appropriate distance resulting in the overall width 26 of the car 10 approaching, but not exceeding, the maximum width permitted by the applicable clearance window associated with the railroad track lines over which the car 10 may be expected to be operated. The absence of support posts on the exterior faces of the sides 22 and 24 of the covered hopper car 10 leaves a long, clean, generally flat, exterior shape for the sides 22 and 24 of the hopper car body 12. Since the upper side wall sheet portions 73 and 74 of the sides 22 and 24 are generally planar, vertical, and parallel with each other a nearly maximum amount of cargo space can be provided between them, while the overall width of the car body remains within the clearance envelope appropriate for the hopper car 10.

Figure 4:
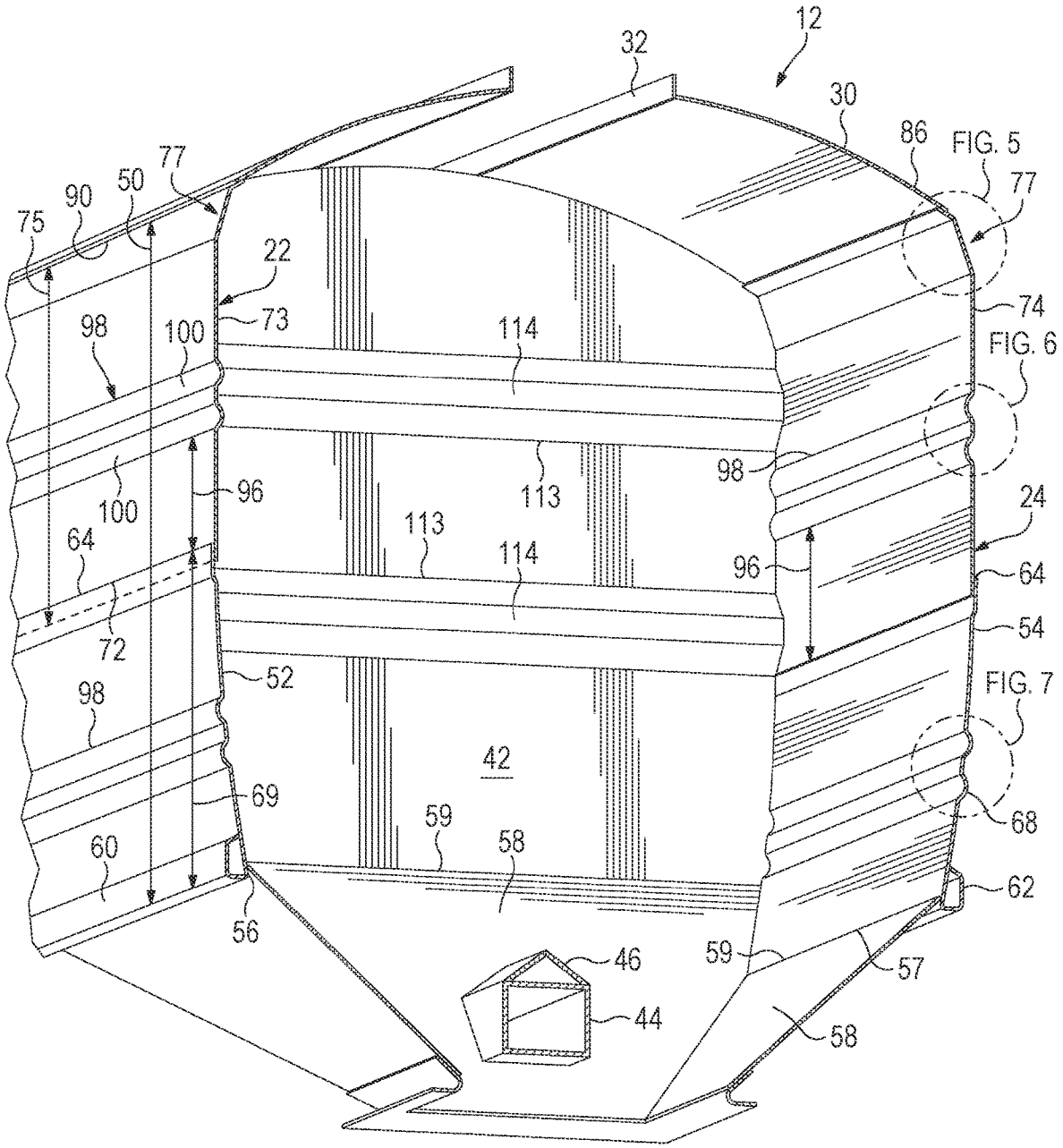
FIG. 4 is an isometric view, taken along line 4-4 of FIG. 1, at an enlarged scale, showing a portion of the car body including the structure of the side walls, a bulkhead, and part of a hopper included in the car body, as well as the top chords and the manner of interconnection of the side walls with the roof of the car body.
Figure 5:
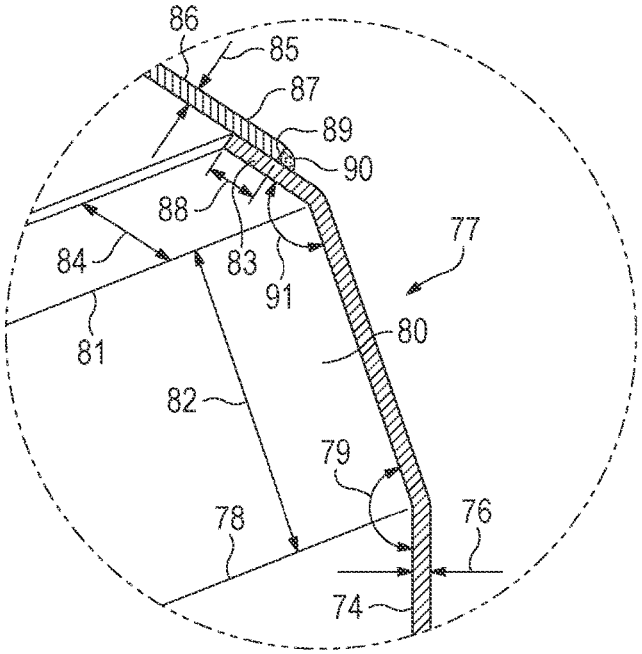
FIG. 5 is a detail view, at an enlarged scale, showing a portion of FIG. 4 including an upper portion of a upper side wall sheet, the top chord of a side wall, and the connection of the side wall with the roof of the car body.

As shown in FIGS. 4 and 5, a top chord 77 of each side 22 and 24 extends along an upper portion of each upper side wall sheet portion 73 and 74. The top chord 77 is preferably constructed as an integral continuation of the sheet steel of the upper side wall sheet portion 73 or 74, demarcated by the sheet steel being bent inward along a first horizontal bend line 78, to form an interior angle 79 in the range of 153° to 173° such as, for example, 163°, to provide an inwardly and upwardly inclined first, main, or lower top chord web portion 80. A further laterally inward bend, forming an interior angle 91 in the range of 127° to 147° such as, for example, 137°, is formed along a second bend line 81, parallel with and spaced apart from the first bend line 78 by a distance or top chord web breadth 82 in the range of 6.4 inches to 10.4 inches, or 8.4 inches, for example. The sheet steel material of the upper side wall sheet portion 73 or 74 may be bent with a radius of curvature of about 0.5 inch along each of the bend lines 78 and 81, clearly defining the top chord 77. The sheet steel of the top chord 77 extends further diagonally upward and inward beyond the second bend line 81, as an upper, inner, flange portion 83 of the top chord 77 with a width 84 of at least 1½ inches.

The arched roof 30 of the car body 12 may be of sheet steel having a thickness 85 in the range of 0.15 inch to 0.19 inch, such as being of 7-gauge sheet steel. The roof 30 may include a lower, laterally outboard sheet steel portion 86 with an outboard margin 87 resting atop and overlapping the upper inner flange 83 of the top chord 77 by a small distance 88, such as about 3/4 inch. The outboard margin 87 of the outboard roof sheet portion 86 is securely attached to the upper flange portion 83 of the top chord 77, as by a welded joint 90 along the extreme outer margin 89 of the outboard sheet 86 of the arched roof 30.

The top chord 77 of the side wall 22 or 24 may preferably be constructed by forming the sheet metal of upper side wall sheet portion 73 or 74, without welding separate pieces together. As a result of forming the top chord 77 as described above and as a result of the manner in which the outboard margin 87 of the roof 30 is attached to the top chord 77, with a single weld joint 90 extending longitudinally along the car body 12, there is a minimum amount of weld joint volume that might tend to shrink and cause visible dimples or wrinkles in the otherwise flat portions of the upper side wall sheet portions 73 and 74 of the car body 12.

Figure 6:
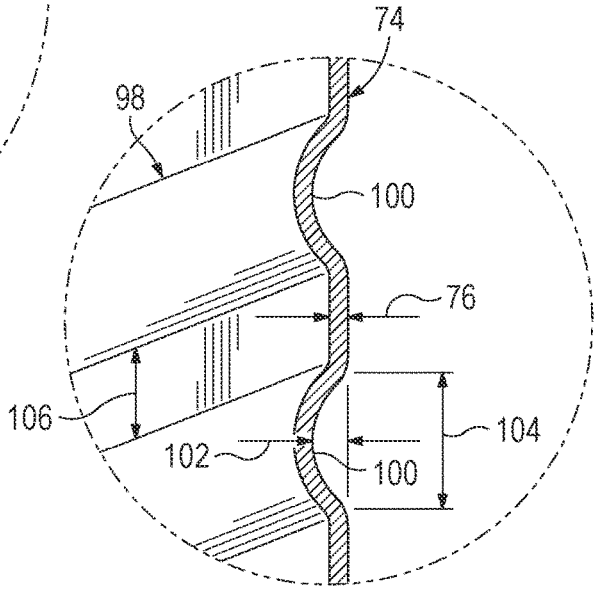
FIG. 6 is a detail view, at an enlarged scale, showing a portion of FIG. 4 including a stiffener included in a upper side wall sheet of the car body.
Figure 7:
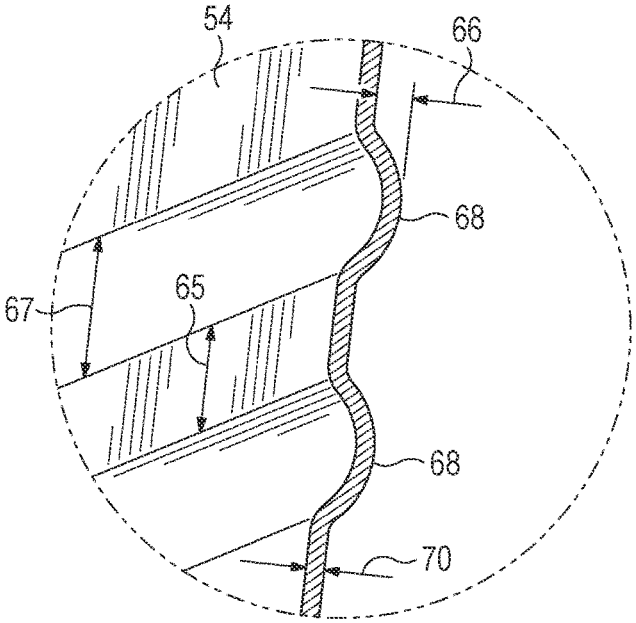
FIG. 7 is a detail view, at an enlarged scale, showing a portion of FIG. 4 including a stiffener portion of a lower side wall sheet of the car body.

At an intermediate height in the upper side wall sheet portions 73 and 74, such as at a distance 96 of 22¼ inches above the weld joints 72 interconnecting the lower portions 52, 54 with the upper side wall sheet portions 73 and 74, a longitudinally-extending stiffener 98 may be provided in each of the upper side wall sheet portions. The stiffener 98 may have the form of, for example, a pair of parallel shallow arcuate-profiled channels 100 that may be formed by rolling the sheet metal material when forming the upper side wall sheet portions 73 and 74 and the top chords 77. For example, as may be seen in greater detail in FIG. 6, the channels 100 may each have a depth of 102 in the range of 3/4 inch to 1½ inch, or 1 1/16 inch, for example, and a height 104 in the range of 4 inches to 7 inches, or 5 inches, for example, measured in a vertical direction along the upper side wall sheet portion 73 or 74, and the channels 100 may be spaced apart from each other by a distance 106 in the range of 1 inch to 4 inches, such as about 2 inches, for example. So as to prevent the overall width of the car 10 from exceeding the clearance limits, the channels 100 may preferably be formed so that they protrude inwardly, rather than bulging outwardly beyond the planes of the upper side wall portions 73 and 74.

At each of the ends 16 and 18 a substantially vertical and generally flat end sheet 110 extends upward from the respective transverse slope sheet 111 of the cargo hopper 34 or 38 defined by that end of the car body 12. Each end sheet 110 is securely attached, as by welding, to the inner side of each of the adjacent upper side wall sheet portions 73 and 74 and to the underside of the roof 30, to complete a closed end of the respective cargo hopper 34 or 38. Each end sheet 110 may include suitable stiffeners (not shown).

At respective positions along the length 20 of the car body 12 the bulkheads 40 and 42 extend upward, between the hoppers 34, 36, and 38, from along the upper margins 59 of the slope sheets 58 to the roof 30. Each bulkhead 40 or 42 extends transversely of the car body 12 and is securely attached, as by being welded, to the interior surfaces of each of the lower side portions 52 and 54, the upper side wall sheet portions 73 and 74, the top chords 77, and the roof 30. Rather than being merely a flat sheet, each bulkhead 40 and 42 may be stiffened by at least one transversely-extending horizontal stiffener 113. Such a stiffener may be of a conventional trapezoidal shape such as incorporating a pair of sloped portions each connected to an offset planar portion 114 extending vertically, parallel with but spaced a small distance apart from, the main plane of the particular bulkhead, as may be seen best in FIG. 1. It will be appreciated that the bulkhead stiffeners 113 may be of other designs, such as including curved corrugations, so long as they provide appropriate rigidity. The bulkheads 40 and 42 separate the hoppers 34, 36, and 38 from one another and provide lateral support for the upper side wall sheet portions 73 and 74, keeping them from spreading apart when the car 10 is loaded.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A side wall structure for a covered hopper railroad freight car, comprising:

(a) a substantially vertically and longitudinally oriented upper side wall member of sheet metal construction;

(b) a top chord of the side wall, the top chord being integrally formed with a top of the upper side wall member, a web portion of the top chord sloping laterally inwardly at an angle in the range of 153° to 173° with respect to the substantially vertically oriented upper side wall member of the side wall, the web portion of the top chord being demarcated with respect to the upper side wall portion by a first bend line extending longitudinally of the side wall member, the upper side wall member and the top chord being a single sheet metal having opposed first and second surfaces, the first surface defining an exterior of the covered hopper railroad freight car and the second surface defining an interior of the covered hopper railroad freight car; and (c) the top chord also including an upper flange portion oriented at a further inwardly inclined angle in the range of 127° to 147° with respect to the web portion of the top chord, and the upper flange portion of the top chord being defined with respect to the web portion of the top chord by a second bend along a second bend line parallel with the first bend line and spaced apart from the first bend line by a distance in the range of 6.4 inches to 10.4 inches.

2. The side wall structure of claim 1, including a laterally outboard margin of a metal panel of a roof member overlapping an inboard portion of the upper flange portion of the top chord and welded to the upper portion of the top chord.

3. The side wall structure of claim 2 wherein the laterally outboard margin of the roof overlaps the upper inwardly-inclined top chord panel by an overlap width of ¾ inch.

4. The side wall structure of claim 1 including a longitudinally extending stiffener formed in a mid-height portion of the upper side wall member.

5. The side wall structure of claim 1 wherein the web portion of the top chord is inclined at an angle of 17° with respect to the upper side wall member.

6. The side wall structure of claim 1 wherein the second bend line is spaced apart from the first bend line by a distance of about 8.4 inches.

7. The side wall structure of claim 1 wherein the upper flange portion of the top chord has a width of at least 1½ inches.

8. A covered hopper railroad freight car, comprising:

(a) a car body having a pair of opposite ends defining a length of the car body, a pair of side walls defining a width of the car body, and a roof extending laterally between the side walls;

(b) each of the side walls having a substantially vertical upper side wall sheet member and including a top chord portion;

(c) the roof being constructed of sheet metal and having a pair of lateral outboard margins extending longitudinally along the car body;

(d) a respective end sheet at each of the opposite ends of the car body, each end sheet being fastened to each of the upper side wall sheet portions, interconnecting the upper side wall sheet members of the side walls with each other, and each end sheet being fastened to an interior surface of the roof;

(e) a transverse bulkhead located between the opposite ends of the car body, the transverse bulkhead being fastened to each of the upper side wall sheet members, interconnecting the side wall portions with each other, and being fastened to an interior surface of the roof;

(f) the top chord portion and the upper side wall sheet member being constructed of a single sheet metal having opposed first and second surfaces, the first surface defining an exterior of the covered hopper railroad freight car, and the second surface defining an interior of the covered hopper railroad freight car;

(g) each top chord portion including a first, lower, top chord web portion having a lower margin defined by a first bend line extending longitudinally along the respective upper side wall sheet member, and the first, lower, top chord web portion being inclined upwardly and inwardly with respect to the respective substantially vertical upper side wall sheet member, at an interior angle within the range of 153° to 173° ;

(h) each top chord portion including a top chord flange formed integrally with and extending upwardly from the first, lower, top chord web portion as a further extension of the sheet metal of the respective upper side wall sheet member, the top chord flange being defined by a second bend line extending longitudinally with respect to the car body, parallel with the first bend line and spaced apart from the first bend line by a distance in the range of 6.4 inches to 10.4 inches, and the top chord flange being oriented inwardly with respect to the first, lower, top chord web portion at an interior angle in the range of 127° to 147°; and (i) a respective one of the outboard margins of the roof extending along one of the upper, inner, top chord flange portions and overlapping the upper, top chord flange portion by a distance within the range of ⅛ inch to 2 inches and having an extreme margin interconnected with the upper, inner, top chord flange portion.

9. A side wall structure for a covered hopper railroad freight car, comprising:

(a) a substantially vertically and longitudinally oriented upper side wall member of sheet metal construction;

(b) a top chord of the side wall, the top chord being formed at a top of the upper side wall member, the upper side wall member and the top chord being constructed of a single sheet metal having opposed first and second surfaces, the first surface defining an exterior of the covered hopper railroad freight car, and the second surface defining an interior of the covered hopper railroad freight car, a web portion of the top chord sloping laterally inwardly at an angle in the range of 153° to 173° with respect to the substantially vertically oriented upper side wall member of the side wall, the web portion of the top chord being demarcated with respect to the upper side wall portion by a first bend line extending longitudinally of the side wall member;

(c) a second, upper, bend line extending along an upper margin of the web portion of the top chord, defining an inwardly-inclined top chord flange portion, narrower than the web portion of the top chord and bent along the second bend line to define an interior angle in the range of 127° to 147° with respect to the inwardly-inclined web portion of the top chord, and the top chord flange portion having a width of at least 1 ½ inches.

10. The side wall structure of claim 9, including an outer, lower, margin of a roof panel extending along, overlapping upon, and joined to the inwardly-inclined flange portion of the top chord.

* * * * *